United States Patent [19]

Sinclair

[11] Patent Number: 4,556,359

[45] Date of Patent: Dec. 3, 1985

[54] LOAD CARRYING CLAMP ATTACHMENT FOR A LIFT TRUCK

[75] Inventor: Stuart W. Sinclair, Lake Jackson, Tex.

[73] Assignee: Anderson, Clayton & Co., Houston, Tex.

[21] Appl. No.: 633,731

[22] Filed: Jul. 23, 1984

[51] Int. Cl.[4] ..... B66F 9/18

[52] U.S. Cl. ..... 414/621; 294/88; 294/119.1

[58] Field of Search ..... 414/619, 621; 294/88, 294/119.1

[56] References Cited

U.S. PATENT DOCUMENTS 4,185,944 1/1980 Seaberg ..... 414/621

4,279,564 7/1981 Weinert ..... 414/621

*Primary Examiner*—Robert G. Sheridan

*Attorney, Agent, or Firm*—Fulbright & Jaworski

[57] ABSTRACT

A clamp attachment for use on a lift truck having a plurality of slides movable in vertically spaced parallel guides with first and second load clamps connected to the slides and actuated by first and second piston and cylinder assemblies. A ball and socket support supports each of the assemblies from the body for automatically aligning the assemblies for reducing shock load and binding of the assemblies. The supports are limited from rotating about their longitudinal axis. The piston end of the assemblies is removable for easily maintenance while the cylinder remains on the attachment. A front openable hydraulic compartment is positioned in front of the assemblies for simplifying maintenance and for reducing the thickness of the attachment. A bearing slipper telescopically engages each end of each slide and is telescopically movable in the guides for increasing the bearing support of the slides in the guides and to make possible the use of a wide connection between the slide and the clamp arm for welding or bolting without any increase in the attachment thickness for the bolted connection.

10 Claims, 8 Drawing Figures

LOAD CARRYING CLAMP ATTACHMENT FOR A LIFT TRUCK

BACKGROUND OF THE INVENTION

It is well known to provide a clamp for a lift truck having clamp arms which are connected to slides moving within parallel guides and actuated by hydraulic and piston and cylinder assemblies such as disclosed in U.S. Pat. Nos. 4,185,944 and 4,279,565.

The present invention is directed to various improvements in such a clamp by providing a structure which rearranges the hydraulic connections and piping to provide a low profile body height and reduces the thickness of the carriage which allows increased net truck capacity, provides easy maintenance and assessibility for working on the hydraulics, provides a piston and cylinder mounting which reduces binding and piston damage, and provides a structure which increases the support of the load clamps without increasing the width of the carriage.

SUMMARY

The present invention is directed to a load carrying clamp attachment for use on a lift truck having a body adapted to be mounted on a lift truck in which the body has a plurality of elongate vertically shaped parallel guides in which each guide supports a longitudinally movable slide. First and second load clamps are connected to the slides for movement towards and away from each other for supporting and releasing a load. First and second piston and cylinder assemblies are connected to each of the load clamps, respectively, for moving the clamps.

One feature of the present invention is the provision of a ball and socket support supporting the center of each of the piston and cylinder assemblies from the body. This support automatically aligns the cylinder, reduces binding of the piston in the cylinder thereby reduces piston rod damage, reduces wear of internal cylinder parts, and allows the piston and cylinder assemblies to overcome shock loading. The support may include means for limiting rotation of the assemblies about their longitudinal axis while still allowing the ball and socket support to have freedom of movement.

Another feature of the present invention is wherein the piston end of the piston and cylinder assemblies are easily removable for repair and maintenance whereby all of the internal parts may be easily removed while the cylinder remains on the attachment and mounted on a lift truck. In addition, the stuffing box end of the piston and cylinder assembly may be welded in position and the rod packing may be easily replaced by removing a snap ring.

A still further object of the present invention is the provision of a front openable hydraulic compartment positioned in front of the piston and cylinder assemblies which contains the hydraulic connections for simplifying maintenance. In addition, the valve and cylinder hose fittings may be located in the compartment. This allows the use of a low profile body height as the valves are not conventionally located on top of the clamp attachment. Furthermore, the placement of the hydraulic hoses and fittings in the compartment, instead of behind the attachment, allows the thickness of the attachment to be a minimum which in turn provides an increased net truck capacity.

Still a further object of the present invention is the provision of a bearing slipper telescopically engaging each end of each slide telescopically movable in its supporting guide for increasing the bearing support of the slide in the guide. A stop is provided in each guide on each side of the slipper for extending and retracting the slipper on the slide. Bearing pads are positioned between the slipper and the guide and between the slipper and the connected slide.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
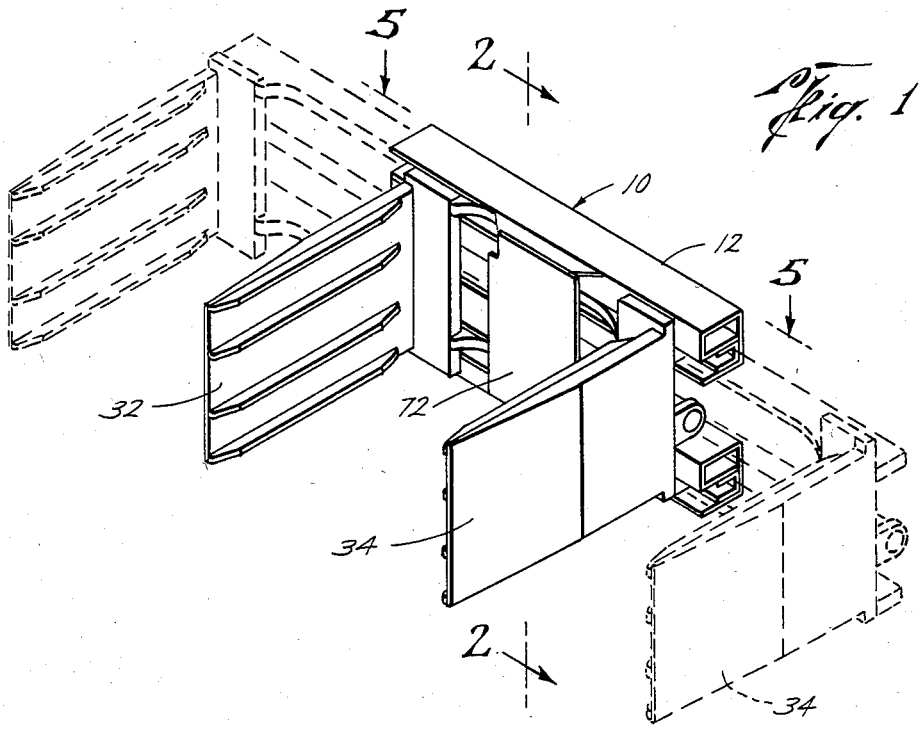
FIG. 1 is an elevational, perspective view of the clamp attachment of the present invention shown with the load clamps in a retracted position in the solid view and in extended position in dotted outline.
Figure 2:
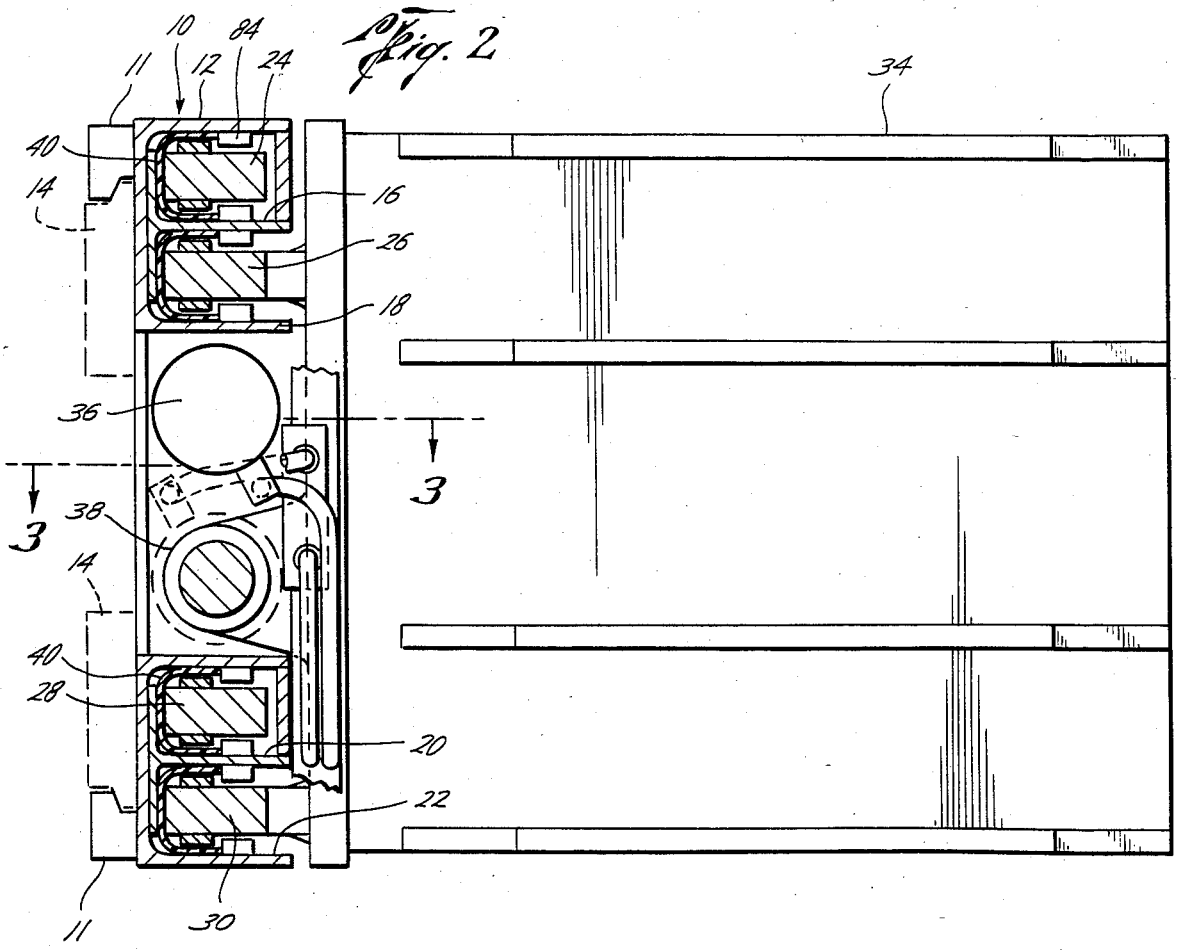
FIG. 2 is an enlarged cross-sectional view taken along the line 2—2 of FIG. 1.
Figure 4:
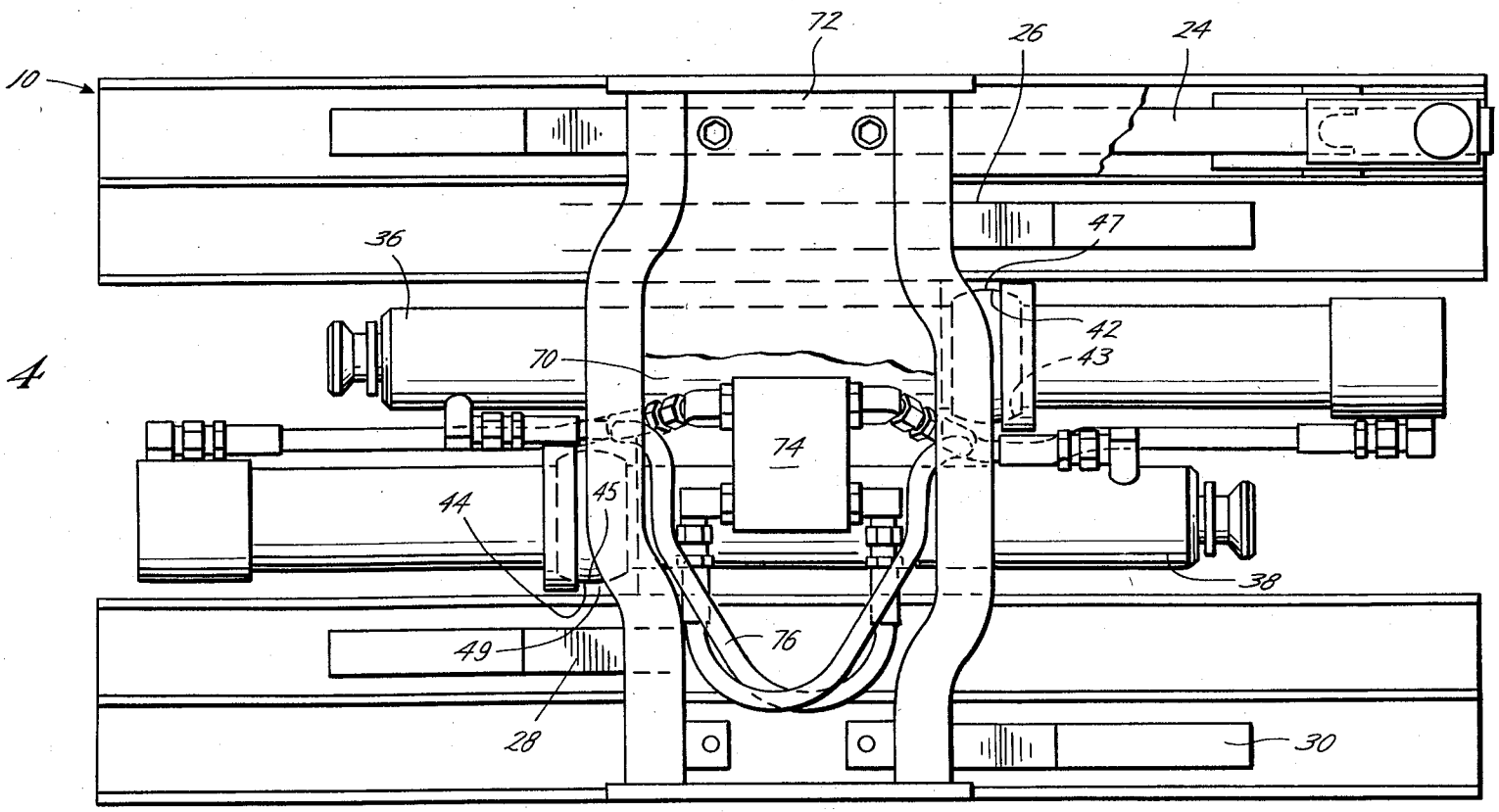
FIG. 4 is a cross-sectional view taken along the line 4—4 of FIG. 3.

Referring now to the drawings, and particularly to FIGS. 1, 2 and 4, the reference numeral 10 generally indicates the load carrying clamp attachment of the present invention which is adapted to be mounted on a lift truck for picking up, carrying and releasing various types of loads. The attachment 10 includes a body 12 having mounting hooks 11 which are adapted to be carried from supports 14 of a lift truck (not shown). The body includes a plurality of elongate vertically spaced parallel guides such as guides 16, 18, 20 and 22. Each of the guides supports a longitudinally movable slide. Thus guides 16, 18, 20 and 22 support movable slides 24, 26, 28 and 30, respectively. First and second load clamps 32 and 34 are provided for gripping, carrying and releasing various types of loads, here shown as suitable clamps for gripping cotton bales. The clamp 32 is connected to one or more slides such as slides 26 and 30 while load clamp 34 is connected to slides 24 and 28.

First and second piston and cylinder assemblies 36 and 38 are provided connected to the load clamps 32 and 34, respectively, for movement of the clamps 32 and 34 towards and away from each other. Suitable wear strips 40 are provided between each of the slides 24, 26, 28 and 30 in the guides 16, 18, 20 and 22, respectively.

Figure 7:
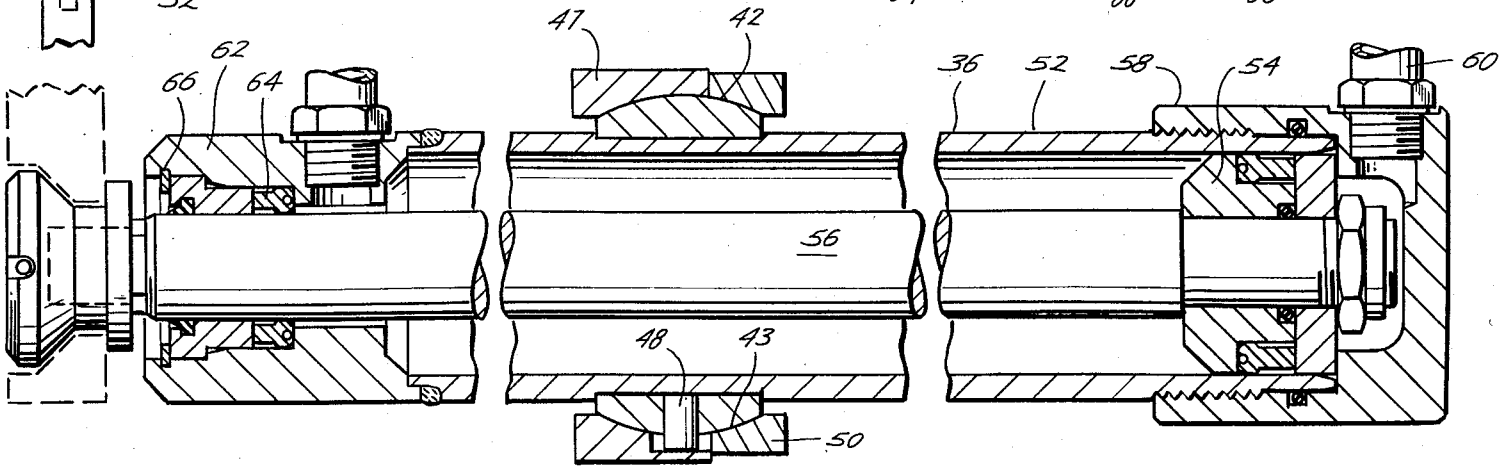
FIG. 7 is an enlarged fragmentary, cross-sectional view of one of the piston and cylinder assemblies of the present invention.

The above general description of a load carrying clamp attachment for a lift truck is known. The present attachment 10 includes various improvements, one of which is the provision of a ball and socket support preferably supporting the center of each of the piston and cylinder assemblies 36 and 38 from the body 12. Referring now to FIGS. 4 and 7, the piston and cylinder 36 includes a ball type support 42 which is supported from the frame 12 by coacting sockets 43 and 47. Similarly, the piston and cylinder assembly 38 is supported by a similar ball support 44 from similar sockets 45 and 49. Each of the ball and socket includes suitable means for limiting rotation of the assemblies about their longitudinal axis which could twist their hydraulic hoses connected to the assemblies. One suitable type of means is an antiturn pin 48 which is positioned in a longitudinal slot 50 in the frame socket half 47 which allows rotative movement of the cylinders in all directions except around their longitudinal axis. The ball and socket support is particularly advantageous as it automatically aligns the piston and cylinder assemblies 36 and 38 as they are operated thereby preventing binding of the piston rod in the cylinder, helps reduces the possibility of piston rod damage, reduces wear of internal cylinder and piston parts, and allows the assemblies 36 and 38 to move and float if the attachment is shock loaded. This structure also reduces the L/R ratio wherein L is the length and R is the radius of gyration of the rod in the assembly for reducing the possibility of piston rod buckling and/or breakage.

The piston and cylinder assemblies 36 and 38 are particularly arranged for ease of maintenance and can be repaired while the assemblies remain on the attachment 10 mounted on a lift truck. Referring now to FIG. 7 the assembly 36 is shown (assembly 38 is similar). Assembly 36 includes a cylinder 52 having a piston 54 with a piston rod 56 extending from the cylinder 52. Since the assemblies are mounted from their centers by the ball and socket supports instead of using the base end of the cylinder to mount the assemblies as is conventional, the assemblies can be easily repaired. An end cap 58 is threadably secured to the cylinder 52. Therefore, by removing the hydraulic connection 60 from the end cap 58, the end cap 58 may be unscrewed and all of the internal parts may be removed, repaired and maintained while the cylinder 52 remains in place in its ball and socket support 42. The stuffing box end 62 is preferably welded to the cylinder 58 and in order to replace the rod packing 64 a snap ring 66 may be removed to provide easy access and maintenance of the stuffing box seal 64. Normally, repair and maintenance on the piston and cylinder assemblies of lift truck attachments are much more complicated time-consuming and costly.

Figure 3:
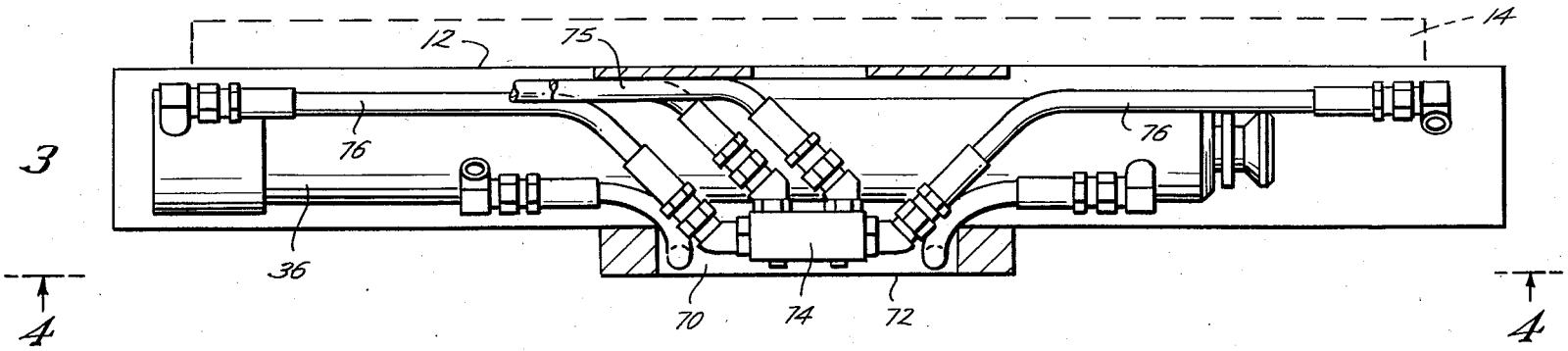
FIG. 3 is a cross-sectional view taken along the line 3—3 of FIG. 2.

Another feature of the present invention is the placement of the hydraulic hoses, valves and cylinder hose fittings. Normally, in conventional attachments, the hydraulic hoses and controls are connected to the back or the top of the carriage 10 which is disadvantageous as it provides hydraulics which are not accessible to maintenance, reduces the ability of the carriage to work close to the ceiling, or increases the thickness of the carriage 10 therefore placing the load further out in front which decreases the net truck capacity. The present invention is directed to providing a front openable hydraulic compartment 70 having a cover 72 which is removable for access to and maintenance of the hydraulic valving and hose connections. Referring now to FIGS. 2, 3 and 4, the supply hoses 75 supply hydraulic fluid to the hydraulic valving 74 which is positioned in the compartment 40 and the various hoses 76 leading to and from the controls on the lift truck and the piston and cylinder assemblies 36 and 38 are positioned in the compartment 70 and between the assemblies 36 and 38 to a great extent thereby overcoming the disadvantages of the prior art attachments. Contrary to conventional attachments, the attachment 10 does not have to be removed from the lift truck to maintain the hoses, fittings, valves or piston and cylinder assemblies.

Figure 5:
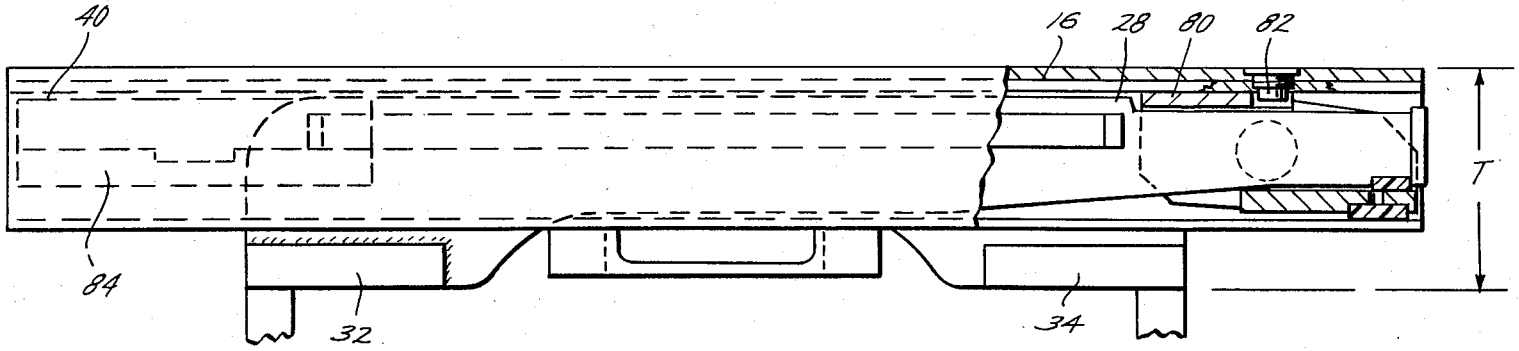
FIG. 5 is an enlarged cross-sectional view taken along the line 5—5 of FIG. 1 showing the clamp in the retracted position with clamp arms being attached by welds.
Figure 6:
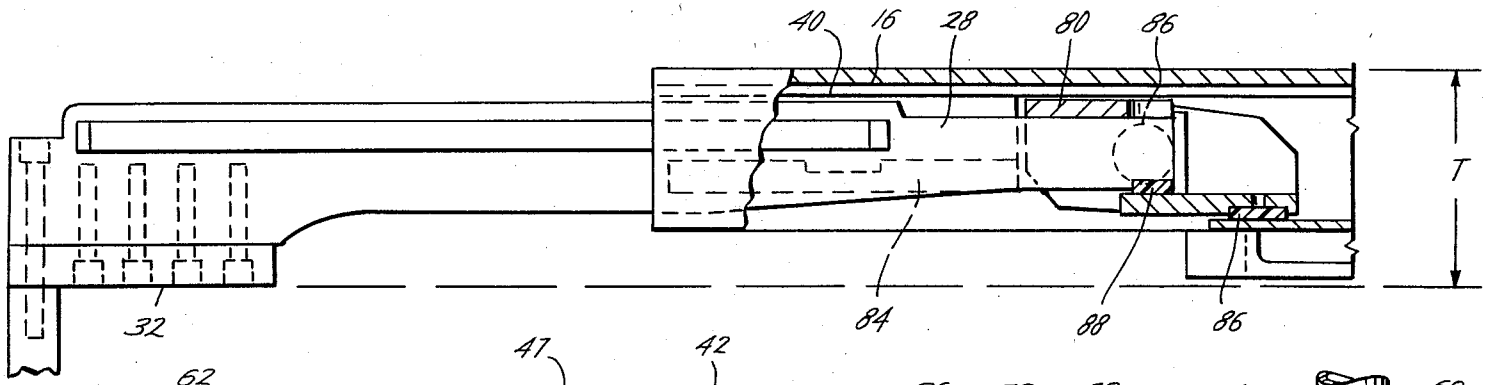
FIG. 6 is a view similar to FIG. 5 showing a clamp arm in the extended position and attached by bolts.

Referring now to FIGS. 5 and 6, each shows one pair of slides operating in a guide. Because of the minimum overall thickness T of the carriage 10, the load clamps 32 and 34 may be attached to the slides by welding, as best seen in FIG. 5 or by a bolted connection as best seen in FIG. 6 without increasing the thickness T and decreasing the load capacity of the lift truck. The thickness T′ is indicated which is the usual conventional thickness of the carriage 10 if the supply hoses 75 were in the conventional position behind the back of the body 12.

Figure 8:
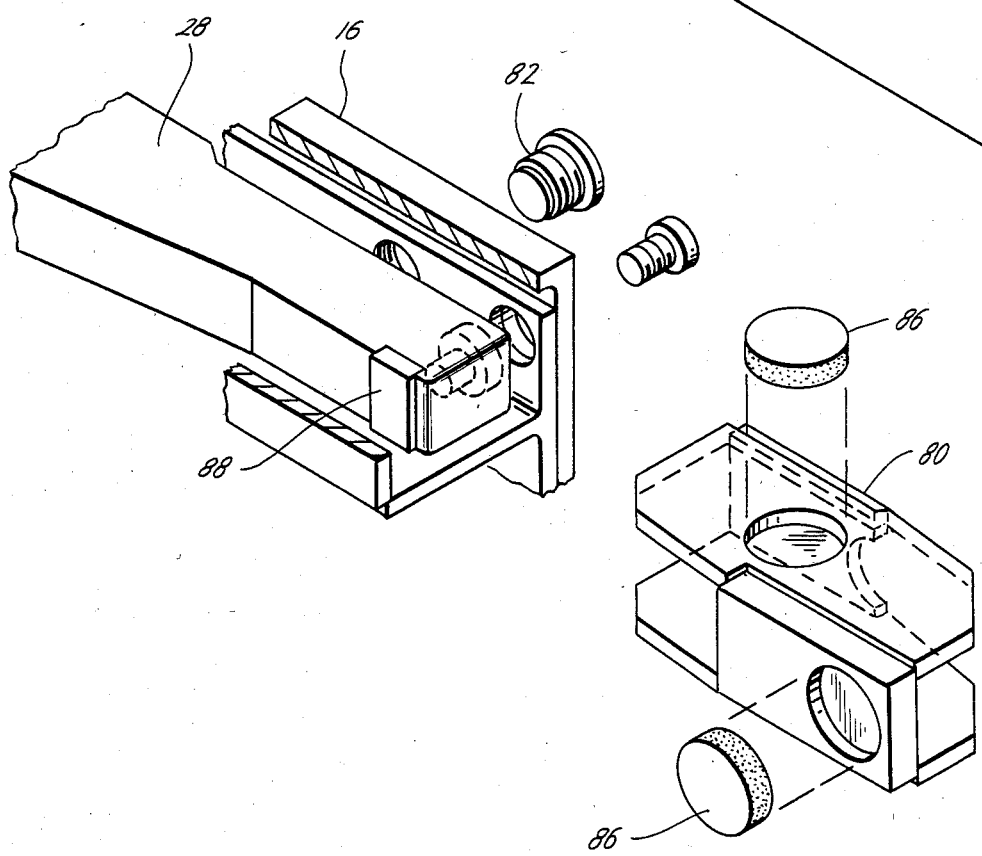
FIG. 8 is a fragmentary perspective exploded view of a bearing slipper which moves on the end of each slide.

Again referring to FIGS. 5, 6 and 8, another feature of the present invention is best seen, which for purposes of illustration is shown in one of the guides such as guide 16 in which moves in the slide 28. A bearing slipper 80 telescopically encloses and moves on the end of each slide, here slide 28, and is telescopically movable in the guide 16 supporting the slide 28. In FIG. 5, the slipper 80 is shown retracted upon the end of the slide 28 while in FIG. 6, the slipper 80 is shown in an extended position on the slide 28. The telescoping slipper 80 increases the length of the guide 28 in the extended position to better support the loads of the extended load clamps 32 and 34. However, the slippers 80 when the load clamps 32 and 34 are retracted, also retract on the end of the slides thereby reducing the requirement of a greater length of body 12 and length of the guides. A stop is provided in the guide 16 on each side of the slipper 80 for extending and retracting the slipper 80 on the slide 28. Thus, a plug 82 is provided in the guide 18 for engaging the slipper 80 as the load clamps move inwardly to retract the slipper 80 onto the slide 28. A stop 84 is provided in the guide 16 on the other side to insure that the slipper 80 is extended from the slide 28 as a load clamp 32 and 34 move outwardly. Preferably, bearing pads are provided between the slipper 80 and the guide 16 such as bearing pads 86 and a bearing pad 88 is provided between the guide 28 and the slipper 80.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. In a load carrying clamp attachment for use on a lift truck having a body adapted to be mounted on a lift truck, said body having a plurality of elongate vertically spaced parallel guides, each guide supporting a longitudinally movable slide, first and second load clamps connected to said slides for movement toward and away from each other for supporting and releasing a load, and first and second piston and cylinder assemblies connected to one of the load clamps for moving said clamps, the improvement comprising, a ball and socket support supporting each of the assemblies from the body for automatically aligning the assemblies for reducing shock loads and binding to the assemblies if the attachment is shock-loaded, and said support including means for limiting rotation of the assemblies and their longitudinal axis.

2. The apparatus of claim 1 wherein the means for limiting rotation includes a pin connected to the support and movable in a slot in the body.

3. The apparatus of claim 1 wherein the piston end of the assemblies is removable for repair and maintenance without removing the assemblies.

4. The apparatus of claim 3 wherein the sutffing box end of the assemblies is secured to the assemblies, and the rod packing is held in position by a snap ring.

5. The apparatus of claim 1 wherein the piston and cylinder assemblies are positioned between parallel spaced guides and including, a front openable hydraulic compartment positioned in front of said assemblies containing hydraulic connections for ease of maintenance.

6. The apparatus of claim 1 including, a bearing slipper telescopically engaging each end of each slide and telescopically movable in the guide supporting the slide for increasing the bearing support of the slide in the guide, and a stop in said guide on each side of the slipper for extending and retracting said slipper on the slide.

7. The apparatus of claim 6 including bearing pads positioned between the slipper and the guide and between the slipper and the connected slide.

8. The apparatus of claim 3 including, a bearing slipper telescopically engaging the end of each slide and telescopically movable in the guide supporting the slide for increasing the bearing support of the slide in the guide, and stops in the guide on each side of the slipper for extending and retracting said slipper on the slide.

9. The apparatus of claim 8 wherein the piston and cylinder assemblies are positioned between parallel spaced guides and including, a front openable hydraulic compartment positioned in front of said assemblies containing hydraulic connection for each of maintenance.

10. In a load carrying clamp attachment for use on a lift truck having a body adapted to be mounted on a lift truck, said body having a plurality of elongate vertically spaced parallel guides, each guide supporting a longitudinally movable slide, first and second load clamps connected to said slides for movement toward and away from each other for supporting and releasing a load, said first and second piston and cylinder assemblies connected to one of the load clamps for moving said clamps, the improvement comprising, a bearing slipper telescopically engaging each end of each slide and telescopically movable in the guide supporting the slide for increasing the bearing support of the slide in the guide, and a stop in said guide on each side of the slipper for extending and retracting said slipper on the slide.

* * * * *